US008695124B2

(12) United States Patent
Hsu

(10) Patent No.: US 8,695,124 B2
(45) Date of Patent: Apr. 15, 2014

(54) TOILET CHEMICAL DISPENSER

(76) Inventor: Jin-Yang Hsu, Taichung County (TW)

( * ) Notice: Subject to any disclaimer, the term of this patent is extended or adjusted under 35 U.S.C. 154(b) by 507 days.

(21) Appl. No.: 12/963,097

(22) Filed: Dec. 8, 2010

(65) Prior Publication Data

US 2011/0138526 A1 Jun. 16, 2011

(30) Foreign Application Priority Data

Dec. 10, 2009 (TW) ..... 98223176 U

(51) Int. Cl.
*E03D 9/02* (2006.01)

(52) U.S. Cl.
USPC ..... 4/231

(58) Field of Classification Search
USPC ..... 4/222–231
See application file for complete search history.

(56) References Cited

U.S. PATENT DOCUMENTS

| | | | | |
|---|---|---|---|---|
| 6,662,380 | B1 * | 12/2003 | Leonard et al. | 4/231 |
| 6,793,190 | B2 * | 9/2004 | White et al. | 248/500 |
| 6,854,136 | B2 * | 2/2005 | Leonard et al. | 4/231 |
| 2004/0040074 | A1 * | 3/2004 | Leonard et al. | 4/231 |
| 2008/0245821 | A1 * | 10/2008 | Itzkowitz et al. | 222/190 |

* cited by examiner

*Primary Examiner* — Lori Baker
(74) *Attorney, Agent, or Firm* — Muncy, Geissler, Olds & Lowe, P.C.

(57) ABSTRACT

A toilet chemical dispenser includes a housing defining an accommodation chamber and a first opening, a cover plate covering the first opening and having a water outlet port. a flow-guide plate upwardly outwardly extended from the cover plate and defining with the cover plate a predetermined contained angle, a chemical box accommodated in the accommodation chamber of the housing and having a second opening facing the first opening and the water outlet port of the cover plate, and a mounting device having its one connected to the housing and its other end thereof for fastening to the top edge of the bowl of a toilet.

17 Claims, 17 Drawing Sheets

TOILET CHEMICAL DISPENSER

BACKGROUND OF THE INVENTION

1. Field of the Invention

The present invention relates to toilet chemical dispensing technology and more particularly, to a toilet chemical dispenser to be mounted in the bowl of a toilet for dispensing toilet chemicals when flushing the toilet.

2. Description of the Related Art

Following rising of living standards of modern family, people do more care about deodorization and indoor air freshening. Many toilet fresheners/cleaning agent dispensers are commercially available. When using a toilet freshener/cleaning agent dispenser in a toilet, the toilet freshener/cleaning agent dispenser may be set in the water tank of the toilet. When the toilet freshener or cleaning agent dissolves in water, a toilet freshening or cleaning effect will be produced upon flushing of the toilet. However, this method is not applicable to a tankless toilet.

Further, there are also many hanging type toilet freshener/cleaning agent dispensers available in the market. When using a hanging type toilet freshener/cleaning agent dispenser, the user can hang the hanging type toilet freshener/cleaning agent dispenser on the inside of the bowl of the toilet. When flushing the toilet, the flushing water will flush the hanging type toilet freshener or cleaning agent, causing the toilet freshener or cleaning agent to be dispensed in water to freshen or clean the bowl of the toilet. Thus, a hanging type toilet freshener or cleaning agent can be used in a tankless toilet.

However, when using a commercial toilet freshener/cleaning agent dispenser, a user may encounter the following problems:

1. Different toilet models have different sizes. After hanging of a toilet freshener/cleaning agent dispenser in the bowl of a toilet, the flushing water may be positively flush the toilet freshener/cleaning agent dispenser. In this case, the toilet freshener/cleaning agent will not be dispensed in the flushing water to clean the inside of the bowl.

2. After flushing the toilet, water drops may drop into the inside of the toilet freshener/cleaning agent dispenser to dissolve the chemicals, producing a residual color fluid that will cause water stains on the inside wall of the bowl of the toilet.

SUMMARY OF THE INVENTION

The present invention has been accomplished under the circumstances in view. It is the main object of the present invention to provide a toilet chemical dispenser, which ensures positive dispensing of the storage toilet chemicals upon each flushing of the toilet.

It is another object of the present invention to provide a toilet chemical dispenser, which avoids dripping of freshener or cleaning agent-dissolved color fluid into the inside of the bowl to cause formation of water stains on the inside wall of the bowl of the toilet after flushing the toilet.

To achieve these and other objects of the invention, a toilet chemical dispenser comprises a housing defining an accommodation chamber and a first opening, a cover plate covering the first opening and having a water outlet port. a flow-guide plate upwardly outwardly extended from the cover plate and defining with the cover plate a predetermined contained angle, a chemical box accommodated in the accommodation chamber of the housing and having a second opening facing the first opening and the water outlet port of the cover plate, and a mounting device having its one connected to the housing and its other end thereof for fastening to the top edge of the bowl of a toilet.

Thus, when the user flushing the toilet after using the toilet, a sufficient amount of the flushing water will flush the storage toilet chemicals, assuring positive dispensing of the toilet chemicals to clean the inside of the bowl.

Further, a drip pan is pivotally connected to the bottom side of the housing and partially protruding over the bottom side of the cover plate. The drip pan has opposing first end and second end, and is biasable relative to the housing between a first position and a second position. When the drip pan is in the first position, the first end of the drip pan is kept above the elevation of the second end. When the drip pan is in the second position, the first end of the drip pan is kept below the elevation of the second end. Subject to the effect of the center of gravity, the drip pan is normally kept in the first position.

Subject to the arrangement of the drip pan, freshener or cleaning agent-dissolved color fluid drops can be collected in the drip pan and will not fall to the inside of the bowl to cause formation of water stains on the inside wall of the bowl of the toilet after flushing the toilet.

Other and further benefits, advantages and features of the present invention will be understood by reference to the following specification in conjunction with the accompanying drawings, in which like reference characters denote like elements of structure.

DETAILED DESCRIPTION OF THE INVENTION

Figure 1:
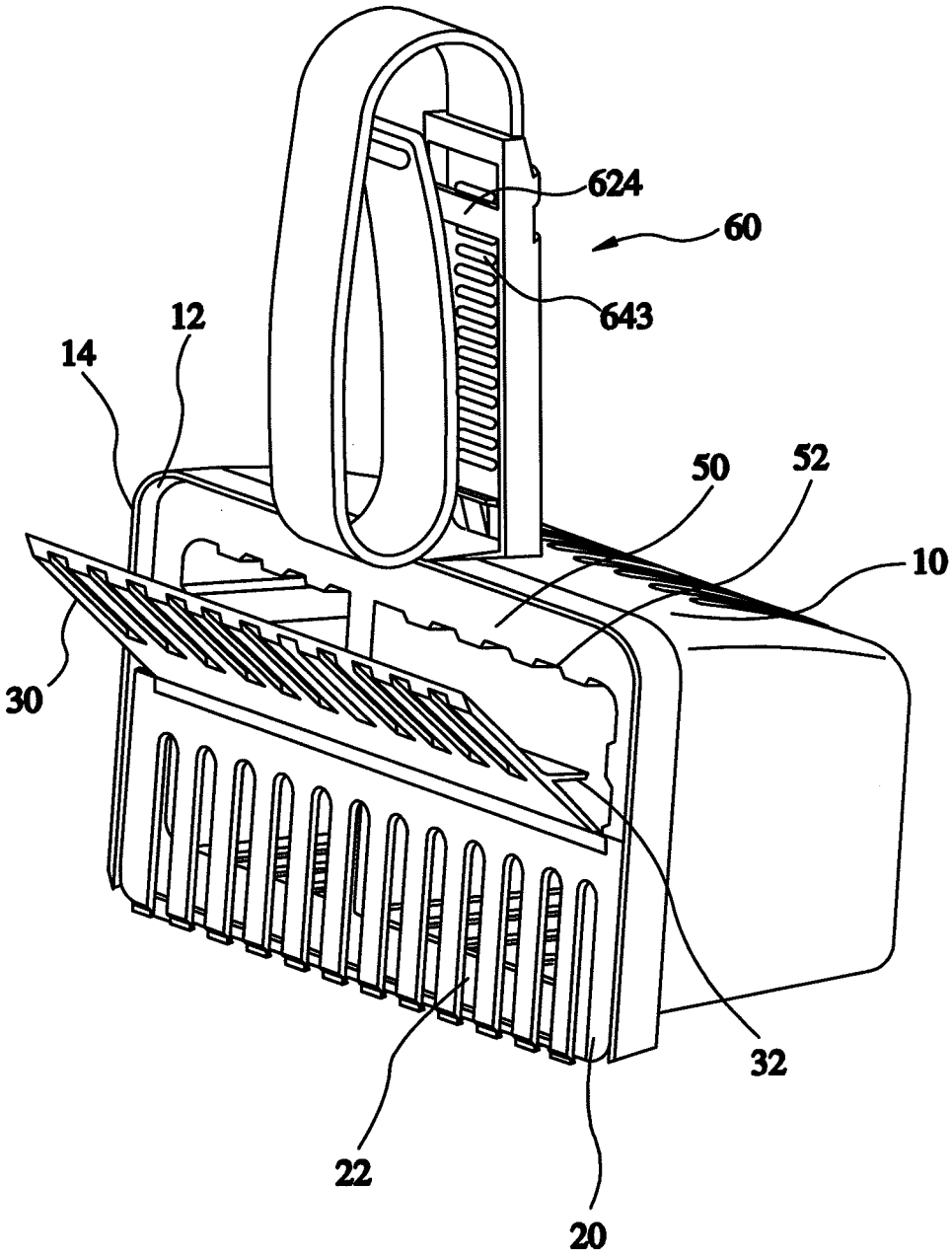
FIG. 1 is an elevational view of a toilet chemical dispenser in accordance with a first embodiment of the present invention.
Figure 2:
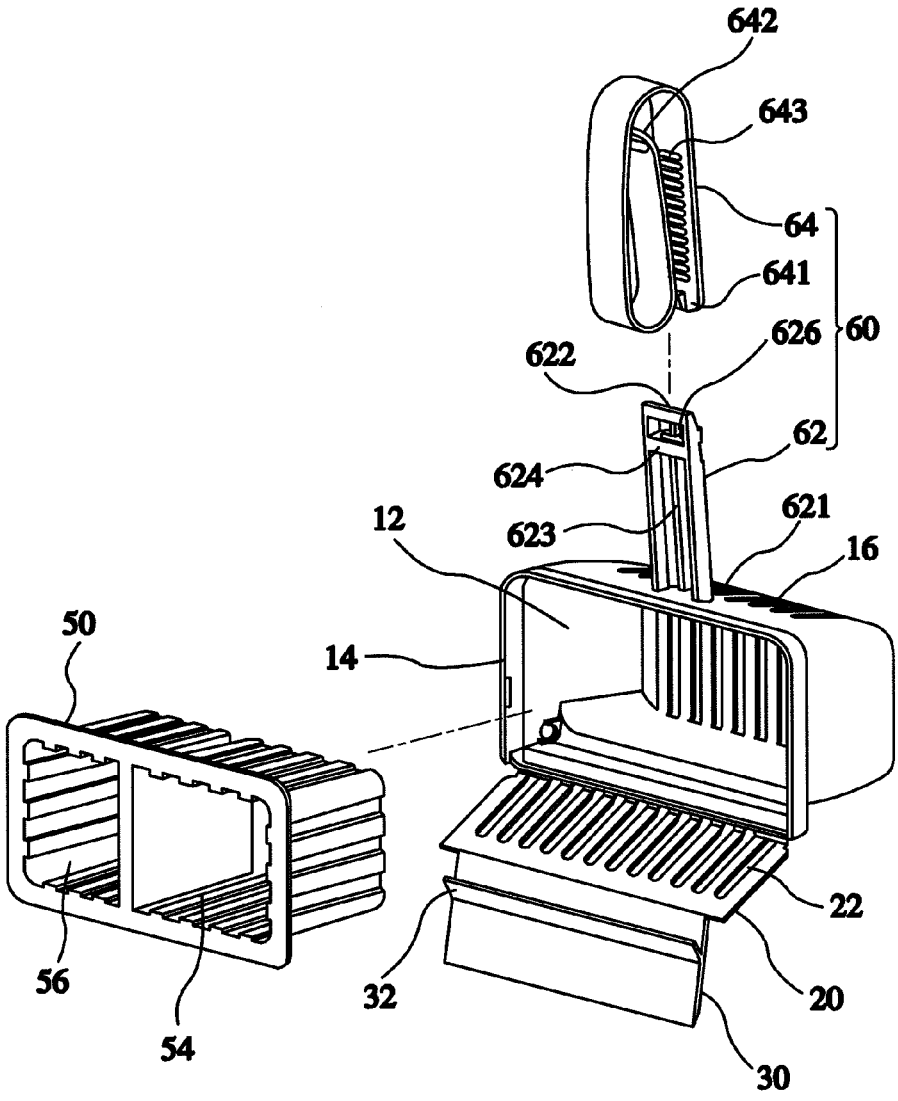
FIG. 2 is an exploded view of the toilet chemical dispenser in accordance with the first embodiment of the present invention.
Figure 3:
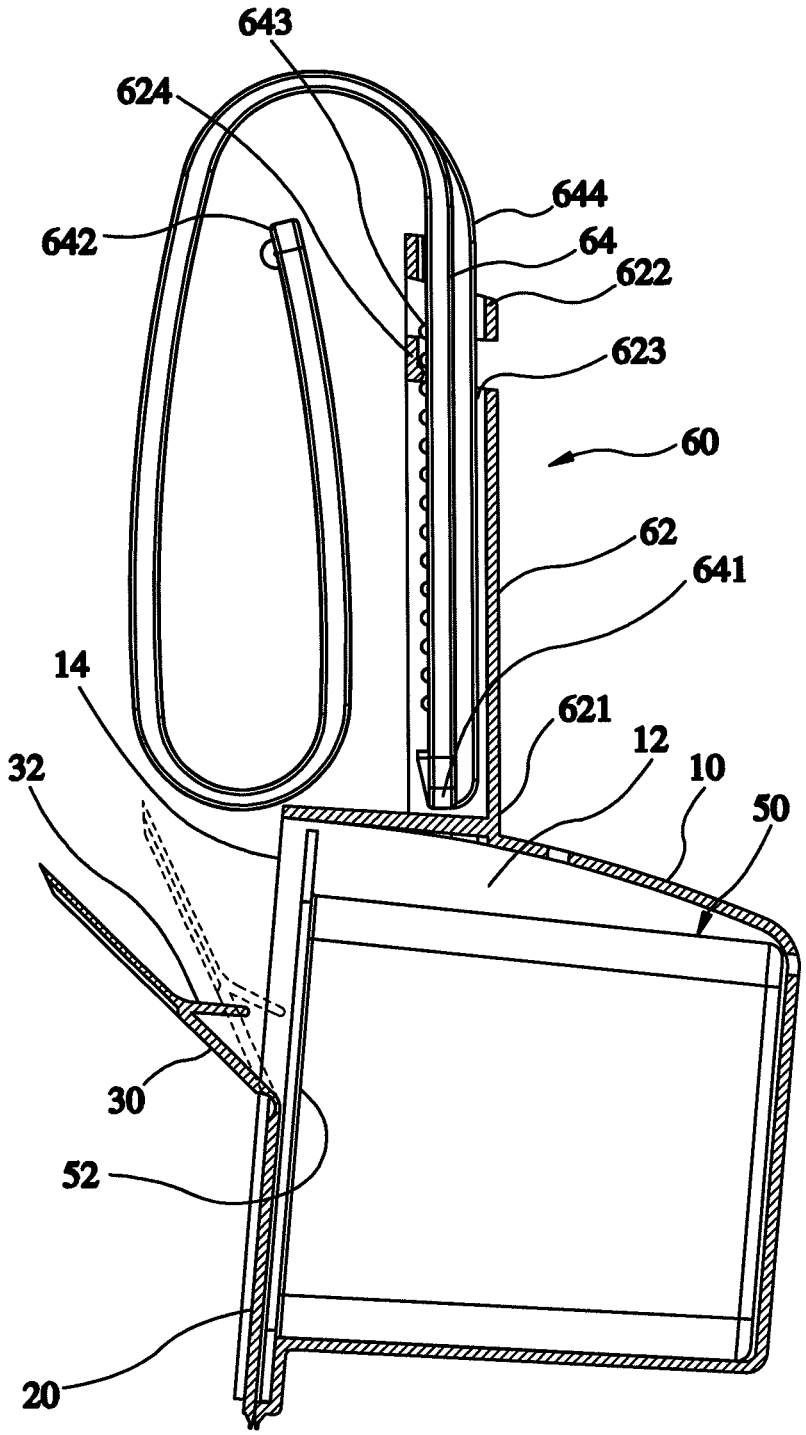
FIG. 3 is a schematic sectional view of the first embodiment of the present invention, illustrating the configuration of the toilet chemical dispenser.

Referring to FIGS. 1-3, a toilet chemical dispenser 1 in accordance with a first embodiment of the present invention is shown comprising a housing 10, a cover plate 20, a flow-guide plate 30, a chemical box 50 and a mounting device 60.

The housing 10 defines an accommodation chamber 12 on the inside, and a first opening 14 at one side. According to this embodiment, the housing 10 includes a drain port 16 disposed at an opposite side relative to the opening 14. Further, the drain port 16 is formed of multiple elongated holes The cover plate 20 is mounted in the housing 10 to cover the first opening 14, having a water outlet port 22. According to this embodiment, the cover plate 20 extends outwards from the housing 10; the water outlet port 22 is formed of multiple elongated holes.

The flow-guide plate 30 extends upwardly outwardly from the top side of the cover plate 20 and defines with the cover plate 20 a predetermined contained angle. According to this embodiment, the flow-guide plate 30 has a baffle plate 32 obliquely downwardly extended from the back side thereof toward the inside of the accommodation chamber 12. The baffle plate 32 defines with the cover plate 20 a predetermined contained angle. Further, the length of the flow-guide plate 30 is shorter than the length of the cover plate 20.

The chemical box 50 is accommodated in the accommodation chamber 12 of the housing 10, having a second opening 52 corresponding to the first opening 14 and the water outlets 22 of the flow-guide plate 30. According to this embodiment, the chemical box 50 is divided into two separated compartments, namely, the first compartment 54 and the second compartment.

The mounting device 60 is made of an elastic material, having one end thereof fixedly connected to the housing 10 and the other end thereof for fastened to the top edge of the bowl of the toilet to keep the housing 10 close to the inside wall of the bowl of the toilet. According to this embodiment, the mounting device 60 includes a mounting member 62 and an extension member 64. The mounting member 62 has two opposite ends, namely, the first end 621 and the second end 622. The first end 621 is fixedly connected with the housing 10. The extension member 64 has two opposite ends, namely, the third end 641 and the fourth end 642. The third end 641 is connected with the second end 622 of the mounting member 62 by means of a sleeve joint. The fourth end 642 is fastened to the top edge of the bowl of the toilet. The fourth end 642 is curled up before use. When in use, the user need to extend out the fourth end 642 and then hook the fourth end 642 on top edge of the bowl of the toilet so that the spring power of the elastic material of the mounting device 60 can force the housing 10 toward the inside wall of the bowl of the toilet.

Further, to facilitate adjustment of the distance between the housing 10 and the top edge of the bowl of the toilet, the mounting member 62 provides a sliding groove 623 and a pawl 624 suspending in the sliding groove 623. The extension member 64 comprises a series of teeth 643. The extension member 64 is slidably inserted into the sliding groove 623 of the mounting member 62. By means of engagement between the teeth 643 and the pawl 624, the extension member 64 is selectively locked to the mounting member 62 in one of a series of positions. The mounting member 62 further comprises a guide groove 626 in the sliding groove 623. The extension member 64 further comprises a rib 644 extending along one side thereof opposite to the teeth 643 and coupled to the guide groove 626 to guide sliding movement of the extension member 64 relative to the mounting member 62.

During the application, a proper amount of freshener 70 and a proper amount of cleaning agent 80 (not shown) are respectively stored in the first compartment 54 and the second compartment 56.

Figure 4:
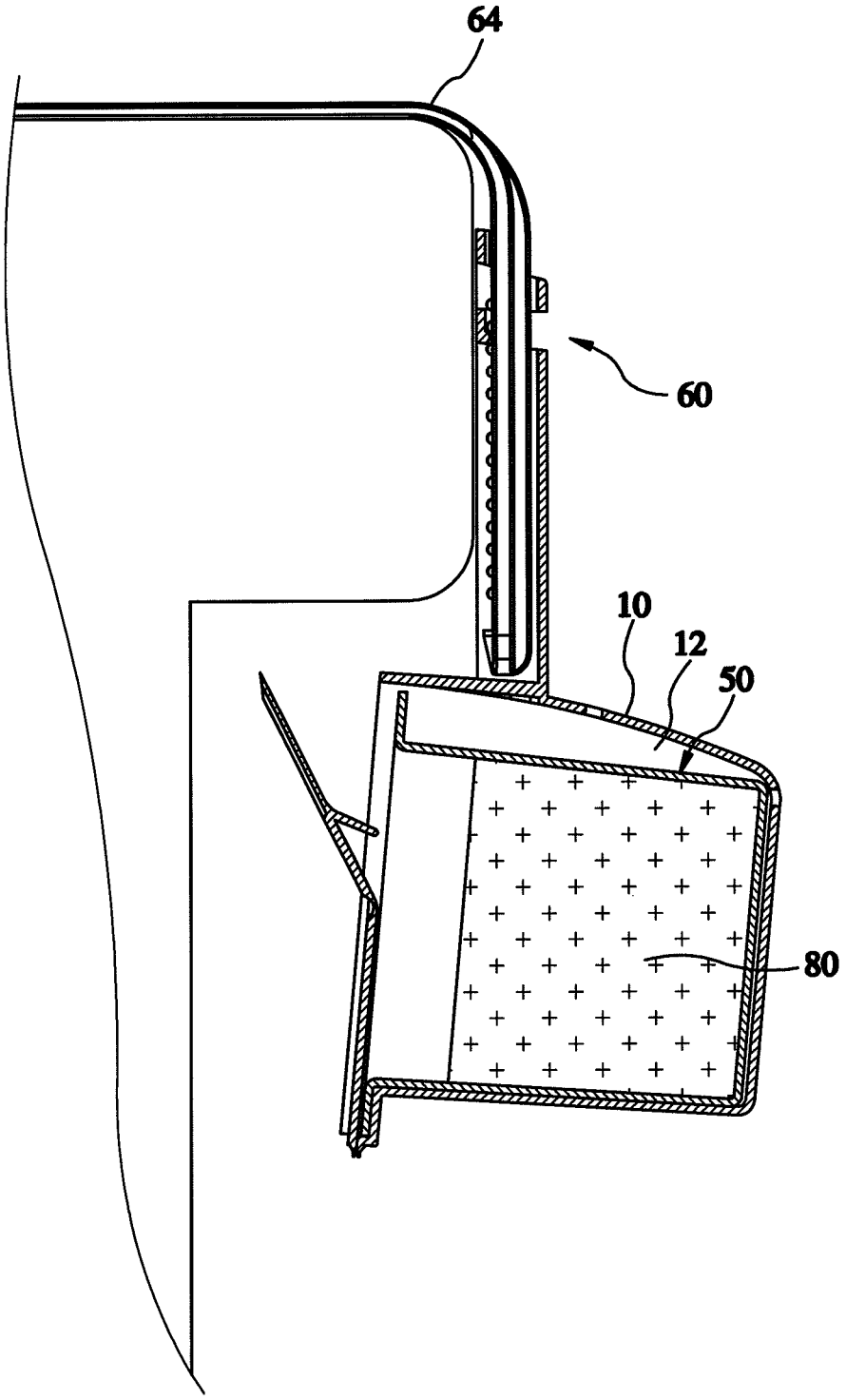
FIG. 4 is a schematic applied view of the first embodiment of the present invention, illustrating the toilet chemical dispenser hung on the top edge of the bowl of a toilet.
Figure 5:
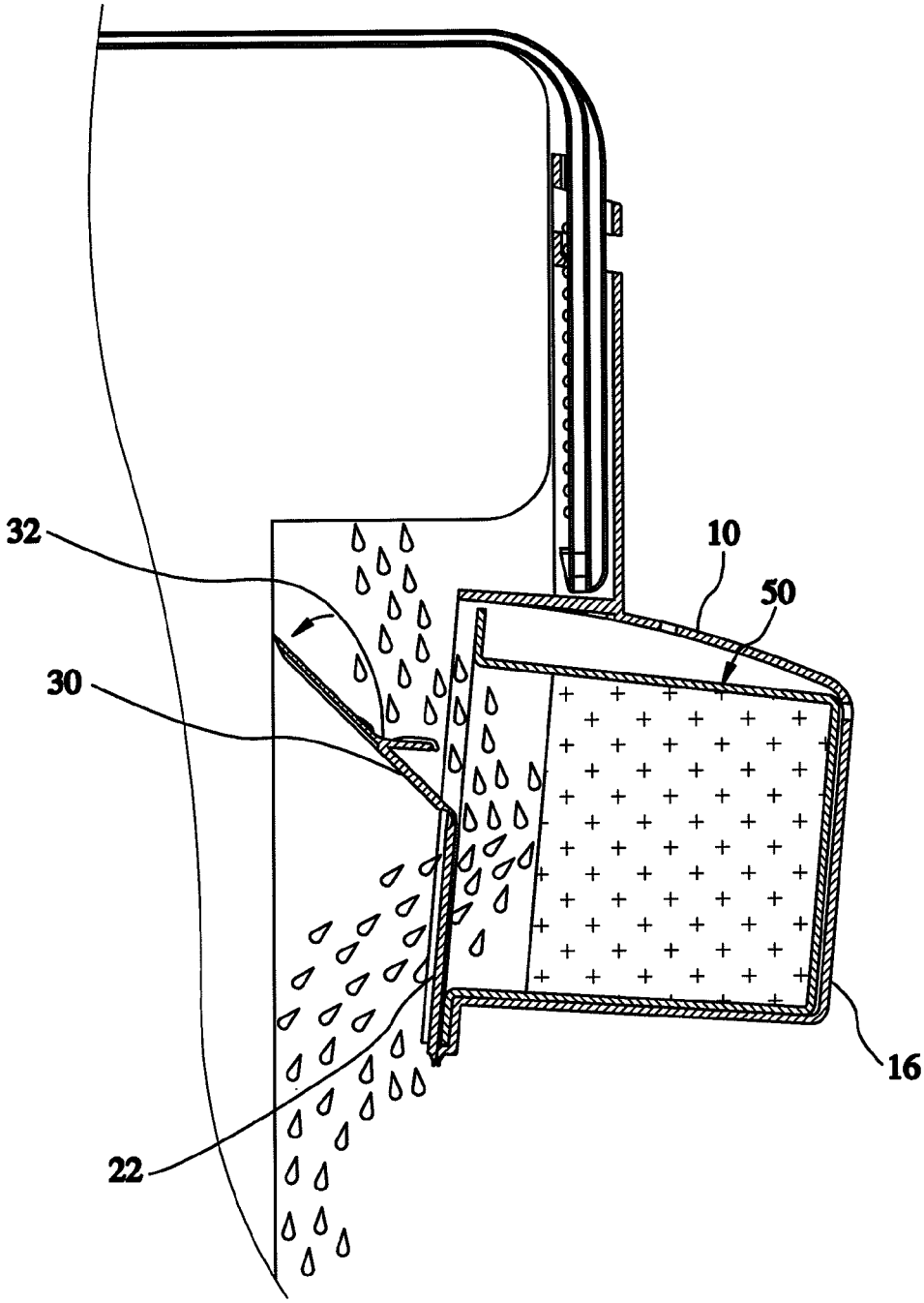
FIG. 5 corresponds to FIG. 4, illustrating toilet flushing water entered the toilet chemical dispenser.

When in use, as shown in FIG. 4 and FIG. 5, after storage of the prepared freshener 70 and cleaning agent 80 in the first compartment 54 and second compartment 56 of the chemical box 50, the user can insert the chemical box 50 into the accommodation chamber 12 of the housing 10. At this time, the second opening 52 of the chemical box 50 faces the first opening 14 of the housing 10. Thereafter, the user can fasten the extension member 64 of the mounting device 60 to the top edge of the bowl of the toilet, enabling the housing 10 to be held inside the bowl and kept close to the inside wall of the bowl.

When the user activated the flushing mechanism of the toilet after using the toilet, flushing water rushes downwardly into the inside of the bowl of the toilet. At this time, the flushing wall will fall upon the flow-guide plate 30 to force the flow-guide plate 30 to swing in direction toward the toilet and to stop at the inside wall of the bowl of the toilet. At this time, the flushing water is guided by the flow-guide plate 30 and the baffle plate 32 toward the inside of the housing 10 to flush the freshener 70 and the cleaning agent 80 in the chemical box 50. At the same time, a part of the flushing water flows out of the housing 10 through the drain holes 16 or the gaps at two opposite lateral sides between the housing 10 and the flow-guide plate 30. When the flushing water flushes the freshener 70 and the cleaning agent 80 in the chemical box 50, the freshener 70 and the cleaning agent 80 are partially dissolved in water and carried by water out of the housing 10 through the water outlets 22 into the inside of the bowl of the toilet.

As stated above, the housing 10 is kept close to the inside wall of the bowl of the toilet after installation of the toilet chemical dispenser in the toilet, and the flow-guide plate 30 can effectively guides the flushing water into the inside of the chemical box 50 in the housing 10. Therefore, when the user flushes the toilet, a sufficient amount of the flushing water will be guided to flush the freshener 70 and the cleaning agent 80, causing the freshener 70 and the cleaning agent 80 to be dispensed in the flushing water.

Figure 6:
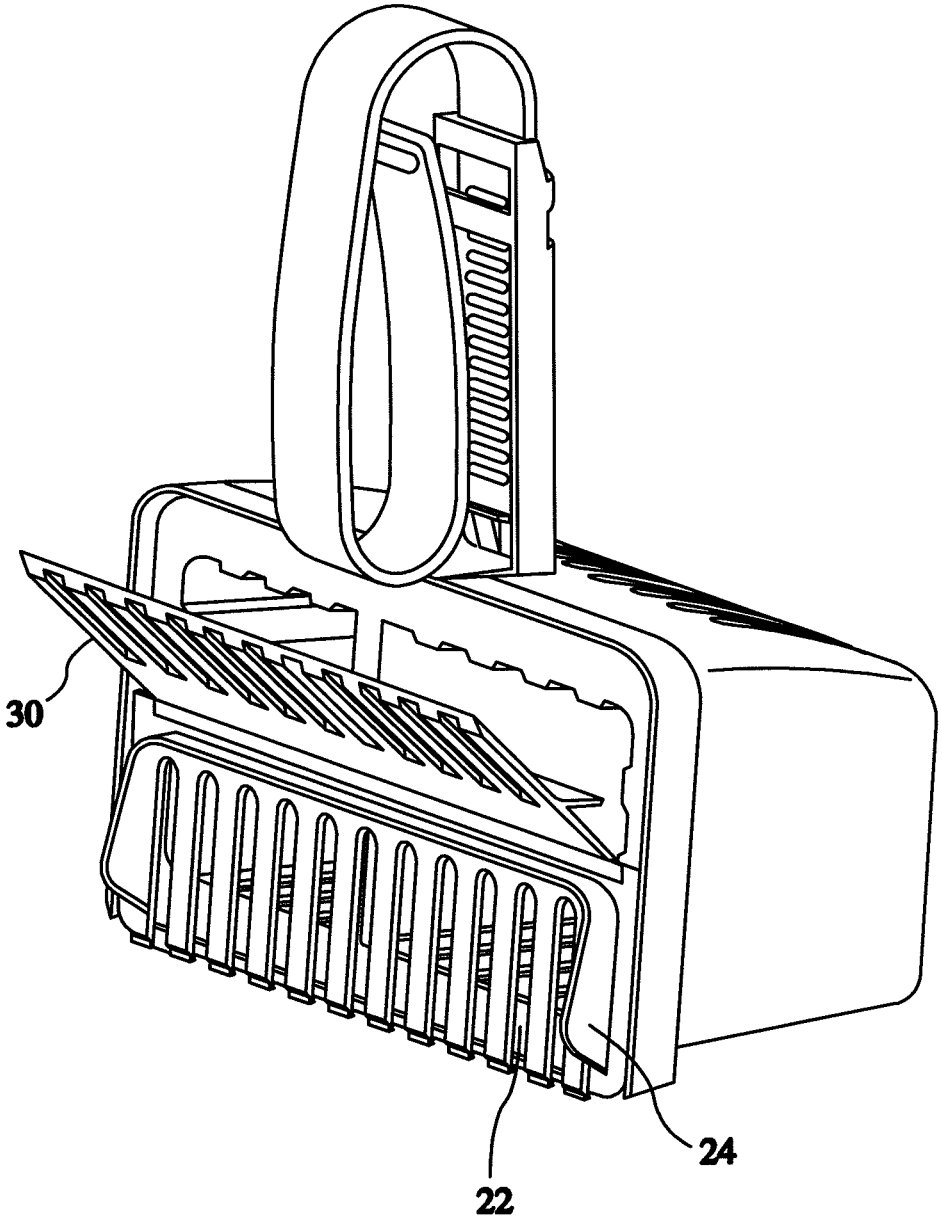
FIG. 6 is an elevational view of a toilet chemical dispenser in accordance with a second embodiment of the present invention.

FIG. 6 illustrates a toilet chemical dispenser in accordance with a second embodiment of the present invention. This second embodiment is substantially similar to the aforesaid first embodiment with the exception that the cover plate 20 of this second embodiment has a rim 24 surrounding the water outlets 22.

The operation of this second embodiment is same as the aforesaid first embodiment. During the use of the toilet chemical dispenser, a part of the flushing water that flows out the gaps at two opposite lateral sides between the housing 10 and the flow-guide plate 30 will be guided downwards by the outer surface of the rim 24. Further, the rim 24 limits the flowing direction of the flushing water that comes out of the water outlets 22, avoiding splashing.

Figure 7:
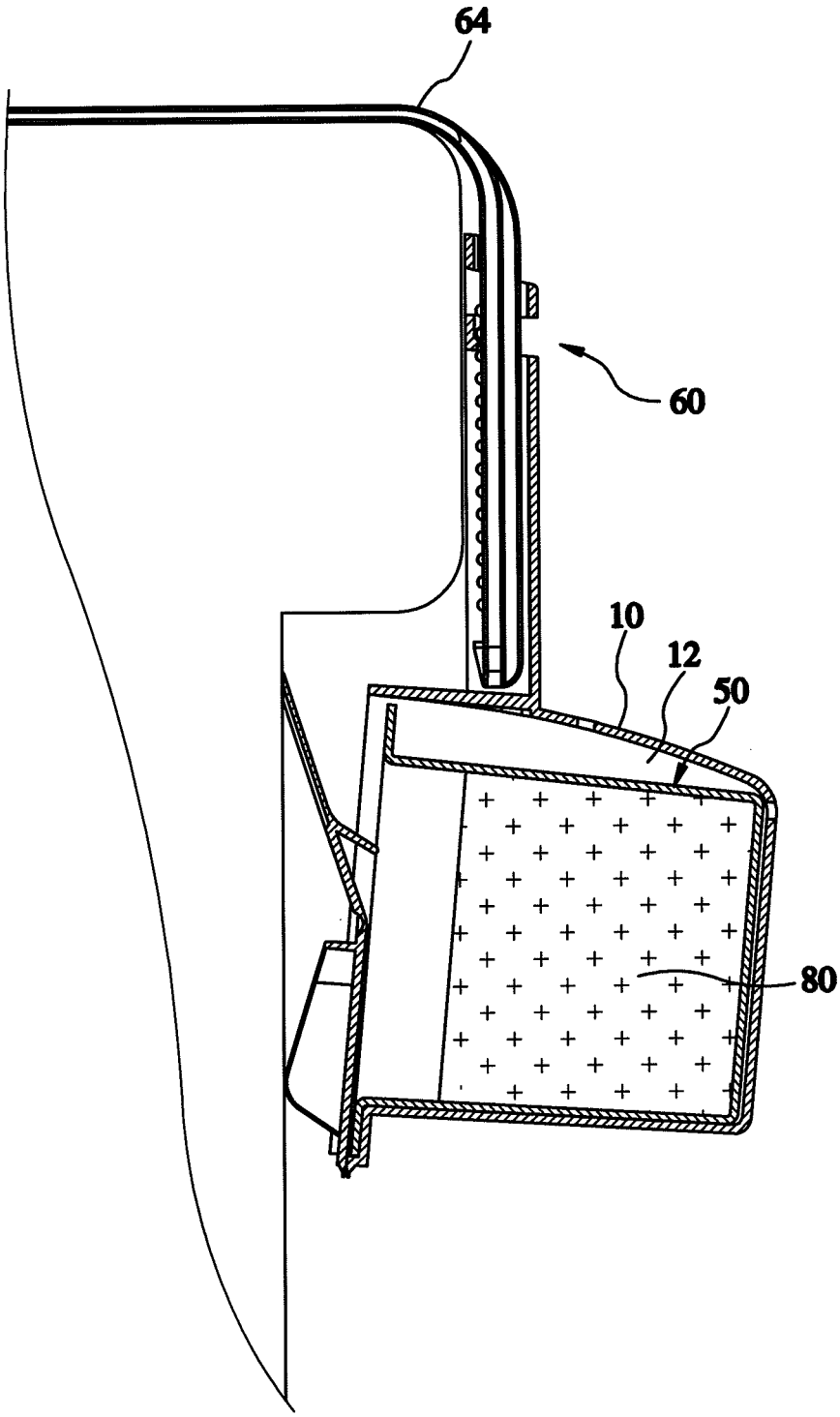
FIG. 7 is a schematic applied view of the second embodiment of the present invention, illustrating the toilet chemical dispenser hung on the top edge of the bowl of a toilet.

Further, as shown in FIG. 7, when the housing 10 is excessively forced toward the inside wall of the bowl of the toilet by the spring force of the extension member 64 of the mounting device 60, at this time, the rim 24 will be stopped against the inside wall of the bowl of the toilet to keep the water outlets 22 away from the inside wall of the bowl of the toilet at a sufficient distance for allowing discharge of the flushing water smoothly.

Figure 8:
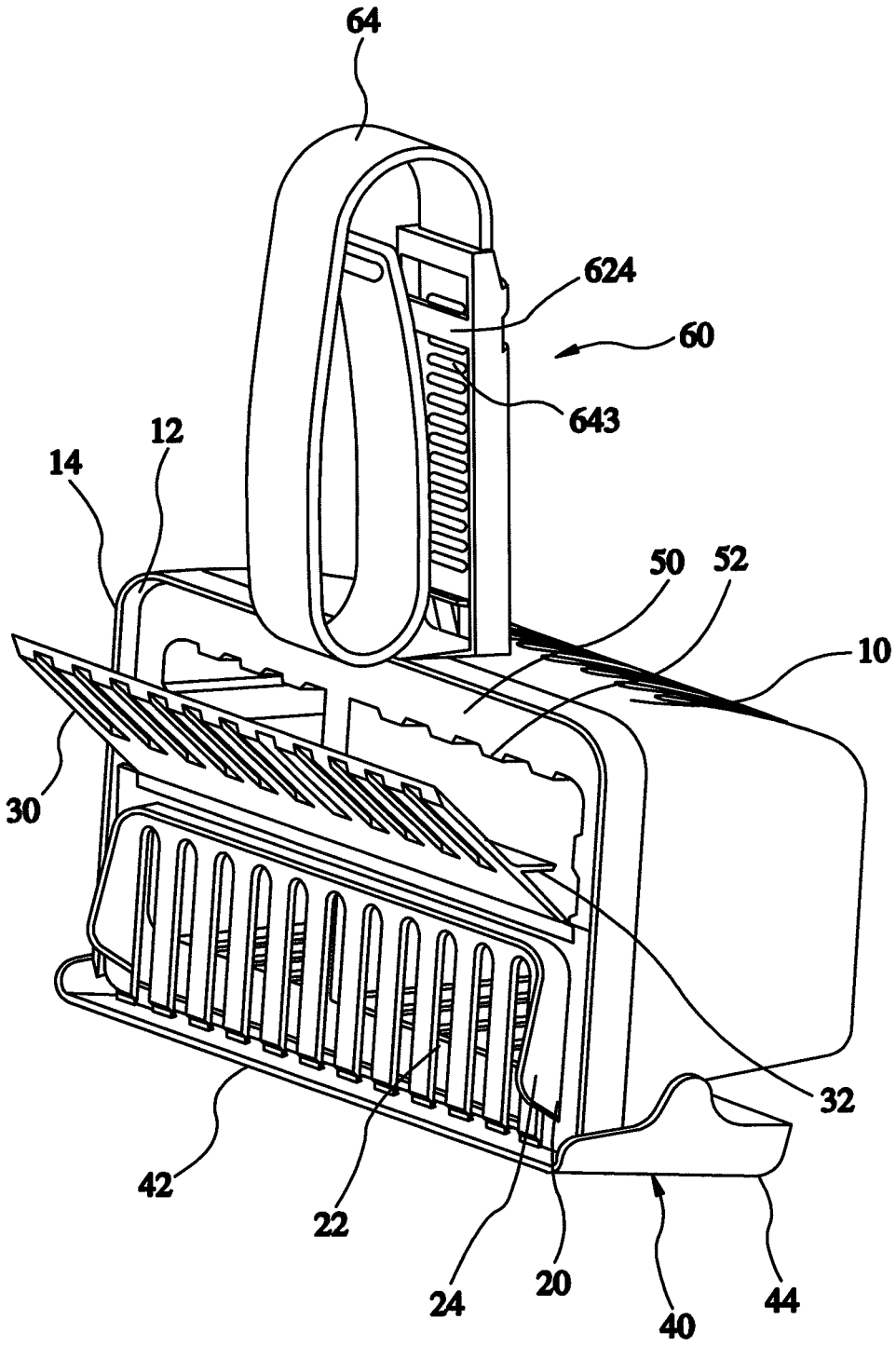
FIG. 8 is an elevational view of a toilet chemical dispenser in accordance with a third embodiment of the present invention.
Figure 9:
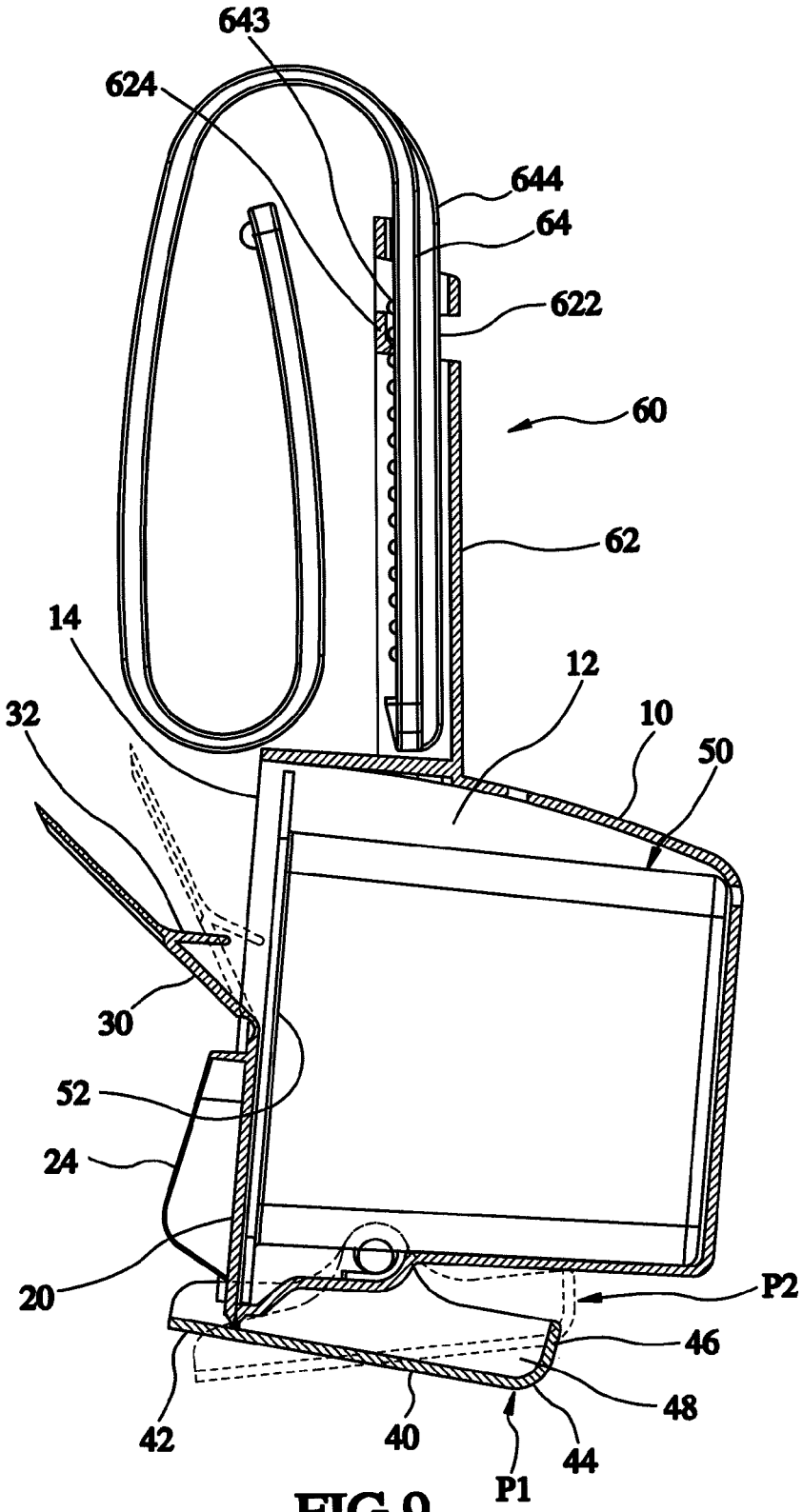
FIG. 9 is a schematic sectional view of the third embodiment of the present invention, illustrating the configuration of the toilet chemical dispenser.

FIGS. 8 and 9 illustrate a toilet chemical dispenser in accordance with a third embodiment of the present invention. This third embodiment is substantially similar to the aforesaid first and second embodiments with the exception of the installation of a drip pan 40. The drip pan 40 has opposing first end 42 and second end 44. The drip pan 40 is pivotally connected to the bottom side of the housing 10 and normally held in such a position that the first end 42 protrudes over the bottom side of the cover plate 20. The drip pan 40 is biasable relative to the housing 10 between a first position P1 and a second position P2. When the drip pan 40 is in the first position P1, the first end 42 is kept above the elevation of the second end 44. When the drip pan 40 is in the second position P2, the first end 42 is kept below the elevation of the second end 44. Further, the drip pan 40 has a retaining wall 46 located on the second end 44. The retaining wall 46 defines with the bottom wall of the drip pan 40 an accumulation chamber 48 for collecting a fluid.

Figure 10:
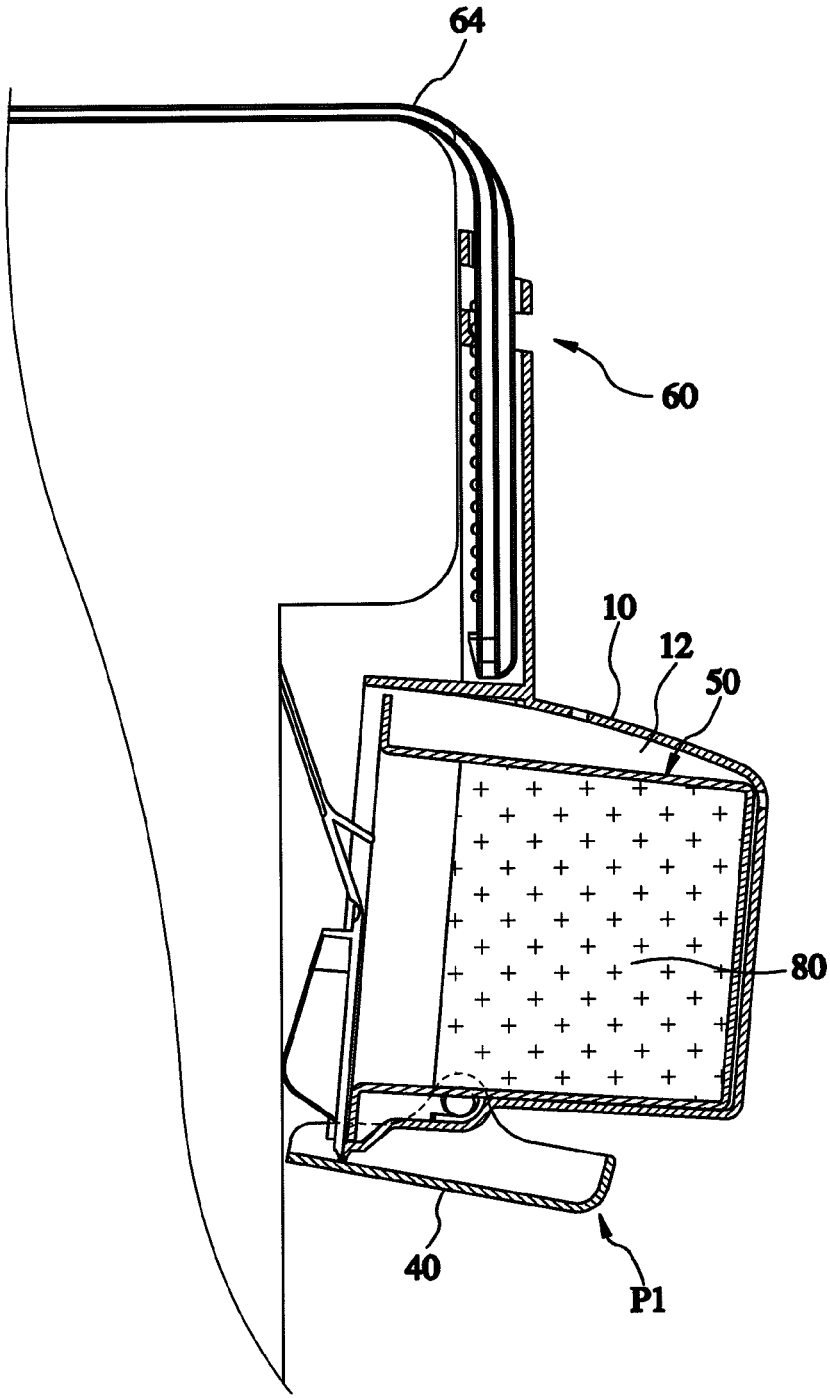
FIG. 10 is a schematic applied view of the third embodiment of the present invention, illustrating the toilet chemical dispenser hung on the top edge of the bowl of a toilet.

As illustrated in FIG. 10, when the housing 10 is excessively forced toward the inside wall of the bowl of the toilet by the spring force of the extension member 64 of the mounting device 60 after installation of the toilet chemical dispenser in the toilet, the rim 24, if any, will be stopped against the inside wall of the bowl of the toilet to avoid direct contact of the first end 42 of the drip pan 40 with the inside wall of the bowl of the toilet as the drip pan 40 is kept in the first position P1, preventing interference with the normal functioning of the drip pan 40.

Figure 11:
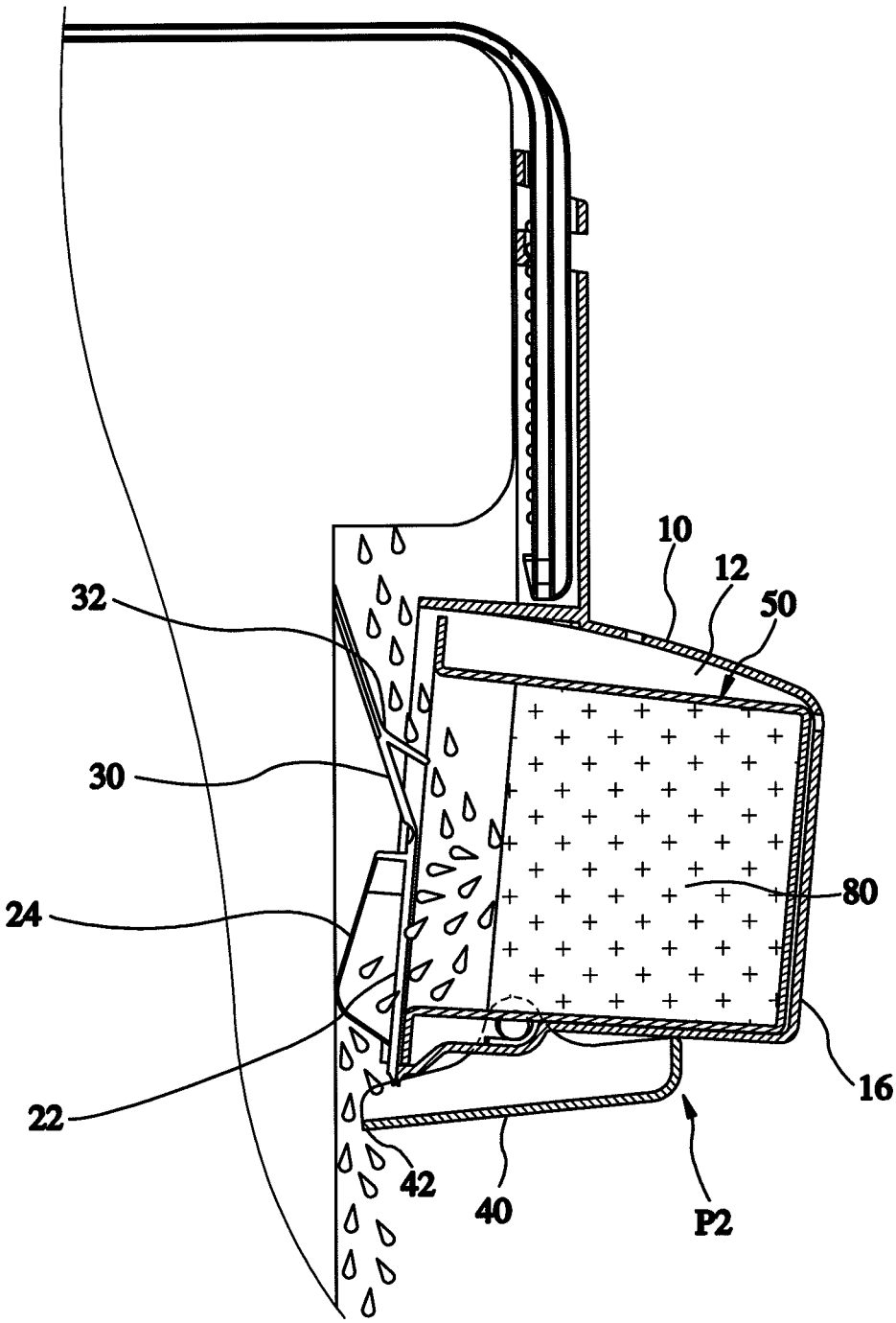
FIG. 11 corresponds to FIG. 10, illustrating toilet flushing water entered the toilet chemical dispenser.

Referring to FIG. 11, when the flushing water flows out of the water outlets 22, it falls upon the first end 42 to bias the drip pan 40 from the first position P1 to the second position P2. Further, the part of the flushing water that flows downwardly along the surface of the rim 24, if any, will also force the first end 42 to bias the drip pan 40 from the first position P1 to the second position P2.

Figure 12:
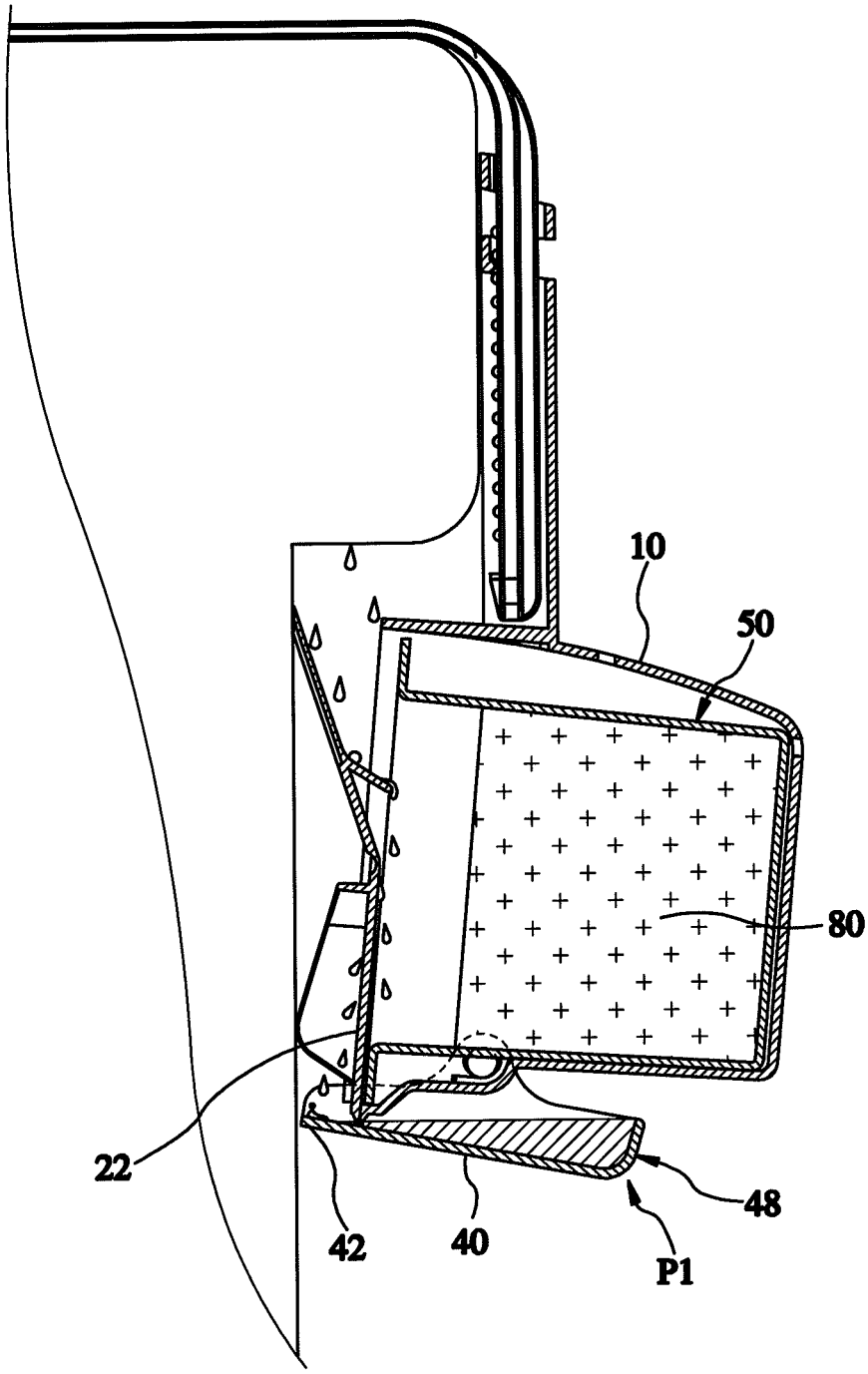
FIG. 12 is another schematic applied view of the third embodiment of the present invention, illustrating water drops accumulated in the accumulation chamber of the drip pan of toilet chemical dispenser in the bowl of the toilet.

Referring to FIG. 12, after the flushing water has been discharged out of the bowl of the toilet, water drops may drop from the bottom surface of the top edge of the bowl of the toilet. At this time, the drip pan 40 will return from the second position P2 to the first position P1 subject to the effect of its center of gravity and the aforesaid water drops will flow through the water outlets 22. Because the drip pan 40 is pivotally connected to the bottom side of the housing 10 and the first end 42 of the drip pan 40 protrudes over the bottom side of the cover plate 20, the water drops that flow out of the water outlets 22 will be gathered in the accumulation chamber 48.

Thus, after flushing the toilet, the drip pan 40 returns to the first position P1 to collect water drops in the accumulation chamber 48, avoiding continuous dripping of freshener 70 or cleaning agent 80-contained fluid into the inside of the bowl of the toilet to cause formation of water stains on the inside wall of the bowl of the toilet.

Figure 13:
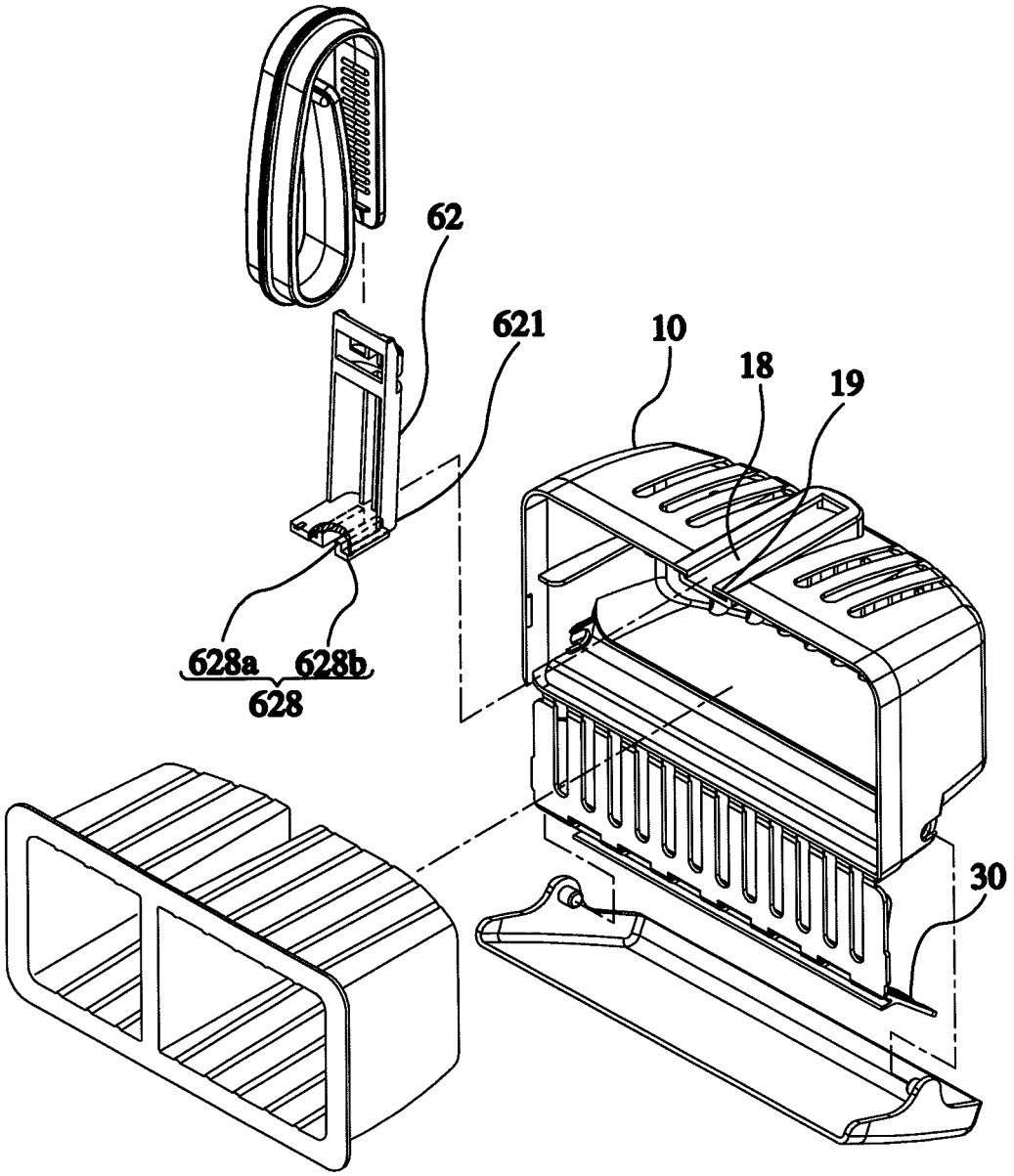
FIG. 13 is an exploded view of a toilet chemical dispenser in accordance with a fourth embodiment of the present invention.

FIG. 13 illustrates a toilet chemical dispenser in accordance with a fourth embodiment of the present invention. Because the distance between the top edge of the bowl and its inside wall varies with different toilet models, an excessive distance between the top edge of the bowl and its inside wall may result in the problem that the spring force of the extension member 64 is insufficient to force the housing 10 toward the inside wall of the bowl of the toilet to the position where flushing water can fall upon the flow-guide plate 30 and guided by the flow-guide plate 30 to flush the freshener 70 and the cleaning agent 80 positively.

This fourth embodiment eliminates the aforesaid problem. Unlike the fixed connection design between the mounting member 62 and the housing 10 in the aforesaid first, second and third embodiments, the mounting member 62 of this fourth embodiment is adjustably connected to the housing 10. As illustrated, the mounting member 62 comprises a coupling component 628 located on the first end 621; the housing 10 comprises a coupling groove 18 adapted for receiving the coupling component 628. The coupling component 628 can be moved along the coupling groove 18 relative to the housing 10.

Further, the coupling component 628 comprises at least one body portion 628*a* and at least one head 628*b*. Each body portion 628*a* protrudes from the first end 621 of the mounting member 62. Each head 628*b* protrudes from one respective body portion 628*a*, and defines with the associating body portion 628*a* a contained angle. According to this embodiment, the coupling component 628 comprises two body portions 628*a* and a head 628*b* at one end of each of the body portions 628*a*. Alternatively, the coupling component 628 can be made comprising one body portion 628*a* and one head 628*b* bilaterally protruded from one end of the body portion 628*a*. The housing 10 further comprises two ribs 19 respectively extending along two opposite sides of the coupling groove 18 and partially projecting into the coupling groove 18. The body portions 628*a* are inserted in between the ribs 19, and the heads 628*b* are kept in the coupling groove 18 and stopped between two opposite sidewalls of the coupling groove 18. Thus, the mounting member 62 is secured to the coupling groove 18, and movable along the coupling groove 18 relative to the housing 10.

Figure 14:
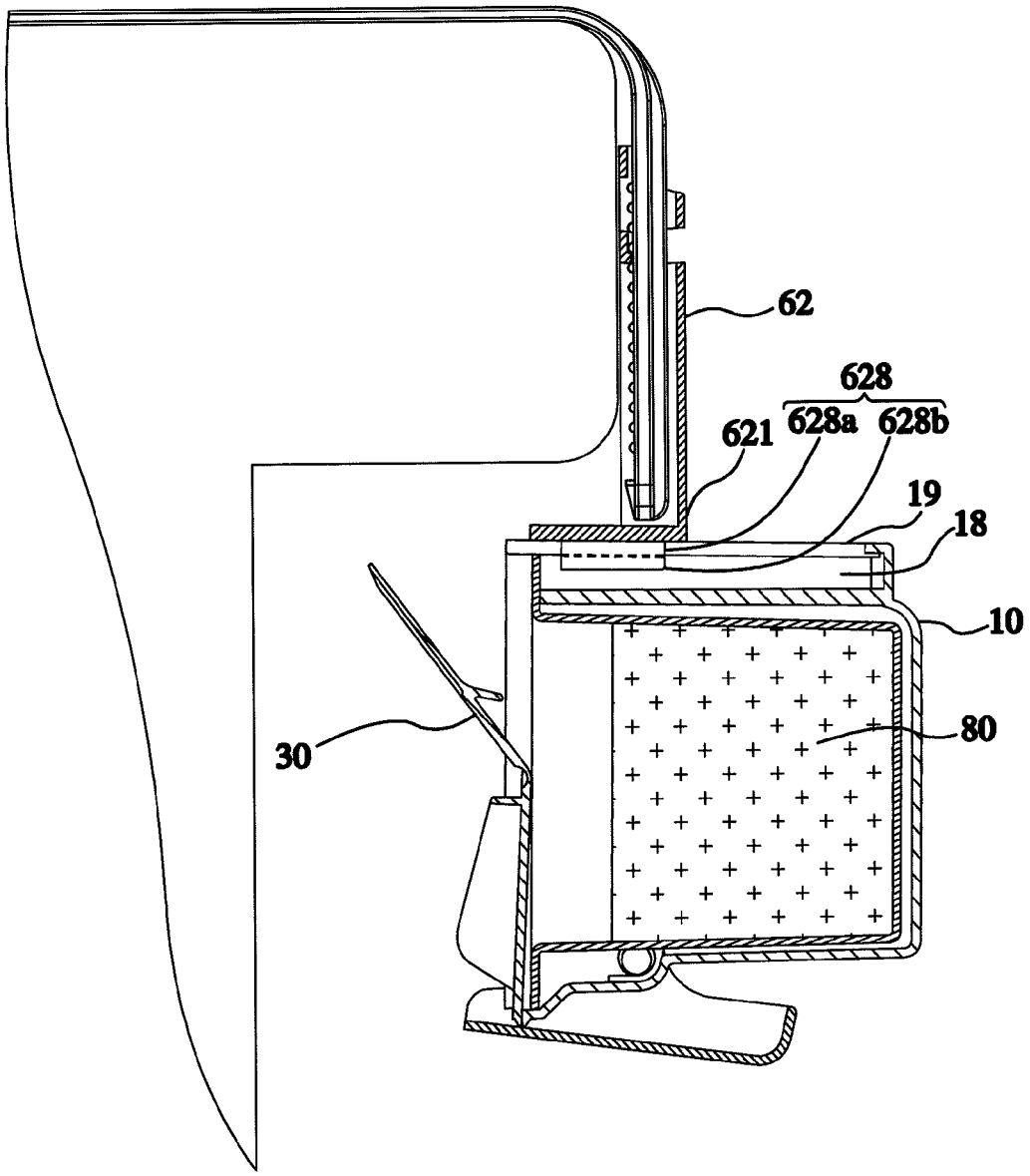
FIG. 14 is a schematic applied view of the toilet chemical dispenser in accordance with the fourth embodiment of the present invention, illustrating the housing suspended in the bowl of the toilet at a distance far from the inside wall of the bowl before adjustment of the position relative to the mounting device.
Figure 15:
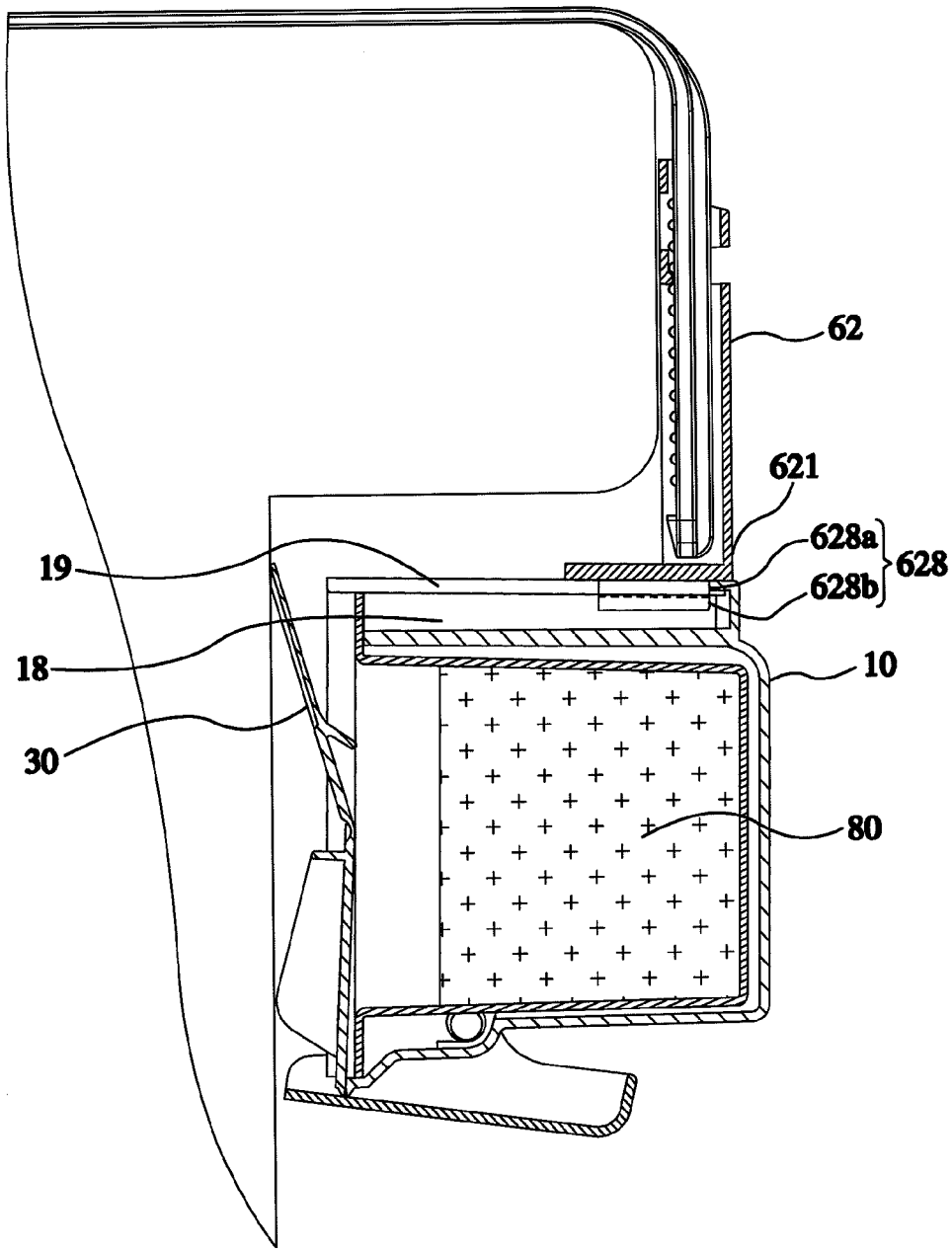
FIG. 15 corresponds to FIG. 14, illustrating the position of the housing adjusted relative to the mounting device and kept close to the inside wall of the bowl.

Referring to FIGS. 14 and 15, if the distance between the between the top edge and inside wall of the bowl is too long to let the flushing water be guided by the flow-guide plate 30 toward the chemical box 50 in the housing 10 after fastening of the mounting device 60 to the top edge of the bowl of the toilet, the user can move the housing 10 toward the inside wall of the bowl of the toilet relative to the mounding device 50, adjusting the position of the flow-guide plate 30 for guiding the falling flushing water to flush the freshener 70 and the cleaning agent 80 positively.

Figure 16:
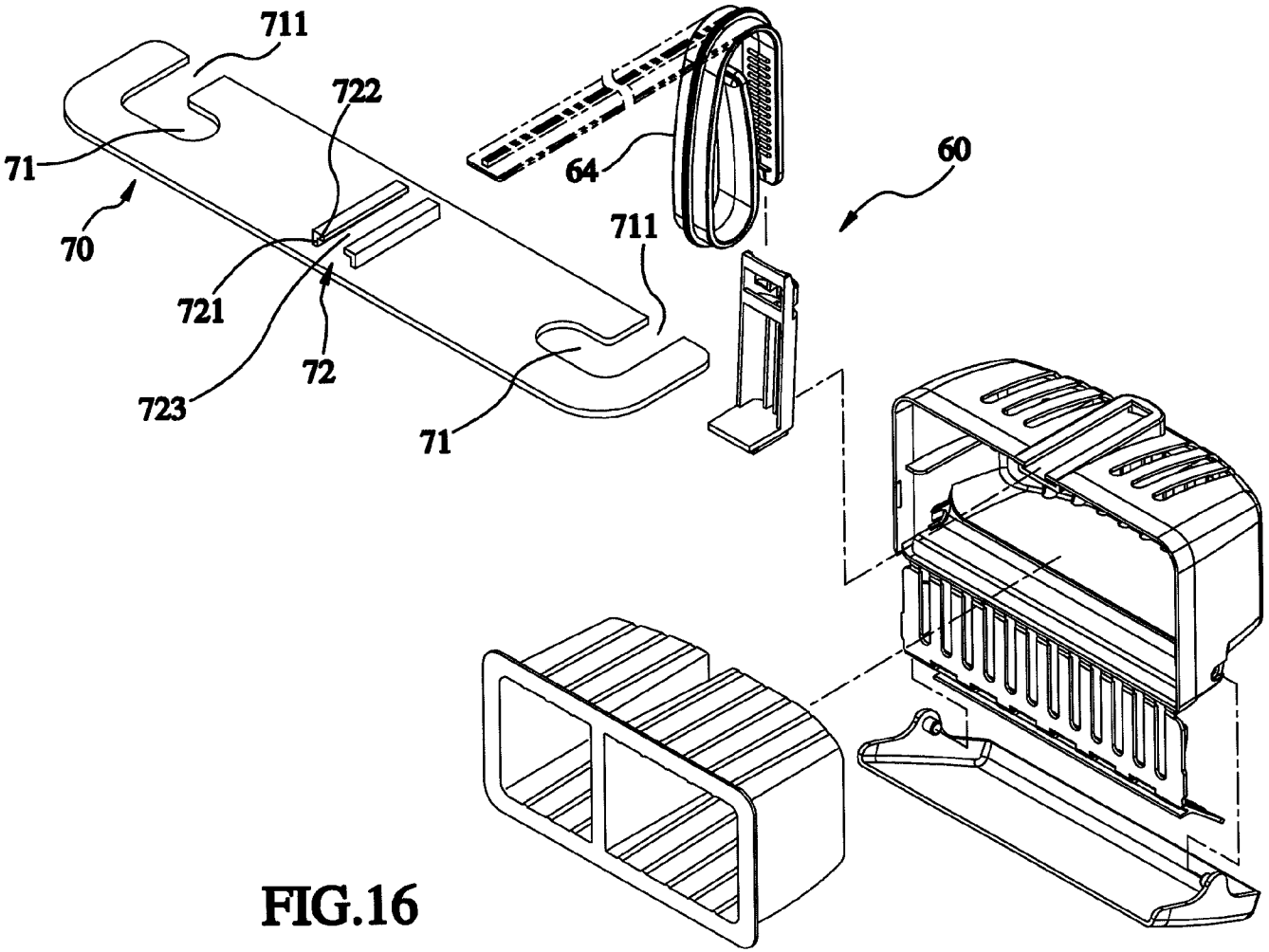
FIG. 16 is an exploded view of a toilet chemical dispenser in accordance with a fifth embodiment of the present invention.
Figure 17:
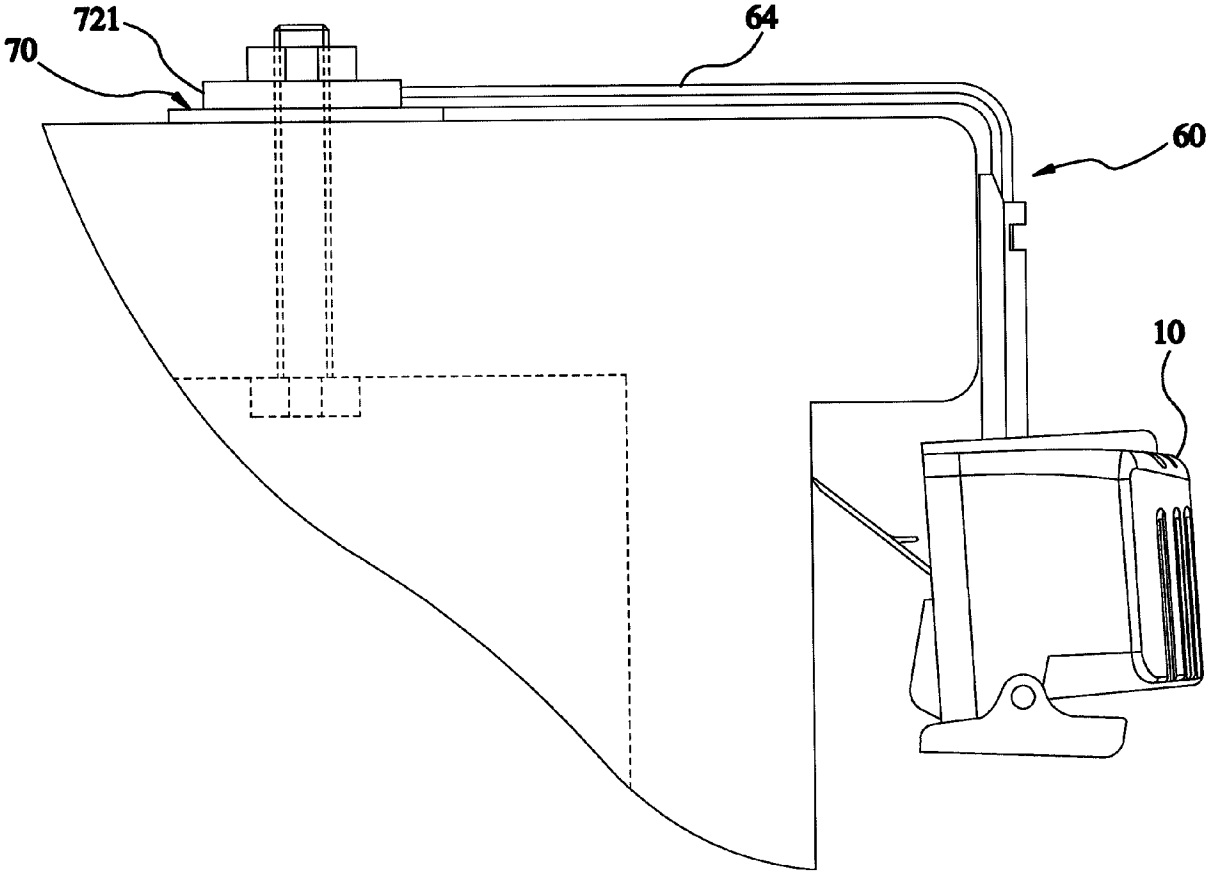
FIG. 17 is a schematic installed view of the fifth embodiment of the present invention, illustrating the extension member of the mounting device fastened to the locating plate at the rear side of the top wall of the bowl of the toilet.

FIGS. 16 and 17 illustrate a toilet chemical dispenser in accordance with a fifth embodiment of the present invention. In the above described other embodiments, the mounting device 60 is adapted for directly fastening to the top edge of the bowl to keep the housing 10 close to the inside wall of the bowl. However, a user may be not want to have the mounting device 60 be directly fastened to the top edge of the bowl. In a regular toilet, screw bolts are arranged on the rear side of the top edge of the bowl for the mounting of a seat. According to this fifth embodiment, the toilet chemical dispenser further comprises a locating plate 70. The locating plate 70 comprises two elongated locating holes 71 respectively disposed near the two distal ends thereof corresponding to the screw bolts on the rear side of the top edge of the bowel, and a coupling structure 72 located on the middle between the two elongated locating holes 71. The coupling structure 72 comprises two rails 721 arranged in parallel, two stop flanges 722 respectively extended from the top side of each of the two rails 721 at right angles along the length of the rails 721 and in direction toward each other, and a coupling groove 723 defined by the rails 721, the stop flanges 722 and the locating plate 70.

The locating plate 70 further comprises two hanging slots 711 respectively and perpendicularly extended from the elongated locating holes 71 to one side edge of the locating plate 70 for allowing insertion of the two screw bolts at the rear side of the top edge of the bowl into the elongated locating holes 71.

During installation of the toilet chemical dispenser of this fifth embodiment, the user can directly attach the two elongated locating holes 71 of the locating plate 70 to the two screw bolts at the rear side of the top edge of the bowl or by means of the hanging slots 711, and then insert the extension member 64 of the mounting device 60 into the coupling groove 723 of the coupling structure 72. At this time, the rails 721 and the stop flanges 722 constrain movement of the extension member 64 of the mounting device 60 to the coupling groove 723 of the coupling structure 72. According to this fifth embodiment, the extension member 64 of the mounting device 60 can be fastened to the locating plate 70 at the rear side of the top edge of the bowl to keep the housing 10 close to the inside wall of the bowl. Thus, the invention settles the problem that the user is unlike to have the mounting device 60 be directly fastened to the top edge of the bowl.

In conclusion, the invention provides a toilet chemical dispenser, which has advantages and features as follows:

1. When the user flushes the toilet after using the toilet, the flow-guide plate 30 effectively guides the flushing water to flush the freshener 70 and the cleaning agent 80, enabling the freshener 70 and the cleaning agent 80 to be positively dispensed into the flushing water.

2. After flushing the toilet, the design of the drip pan 40 prohibits continuous dispensing of the freshener 70 and the cleaning agent 80 into the inside of the bowl to cause formation of water stains on the inside wall of the bowl of the toilet.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A toilet chemical dispenser, comprising:

a housing comprising an accommodation chamber and a first opening;

a cover plate located on said housing and covering said first opening, said cover plate having a water outlet port;

a flow-guide plate upwardly outwardly extended from said cover plate and defining with said cover plate a predetermined contained angle;

a chemical box accommodated in said accommodation chamber of said housing, said chemical box comprising a second opening facing said first opening and said water outlet port of said cover plate; and a mounting device having one end thereof connected to said housing and an opposite end thereof for fastening to the top edge of the bowl of a toilet.

2. The toilet chemical dispenser as claimed in claim 1, wherein said housing comprises a drain port located on one side thereof opposite to said first opening.

3. The toilet chemical dispenser as claimed in claim 1, wherein said cover is formed integral with and extending outwards from said housing.

4. The toilet chemical dispenser as claimed in claim 2, wherein said water outlet port and said drain port are respectively formed of a plurality of elongated holes.

5. The toilet chemical dispenser as claimed in claim 4, wherein said cover plate has a rim extending around said water outlet port.

6. The toilet chemical dispenser as claimed in claim 1, wherein said flow-guide plate comprises a baffle plate obliquely downwardly extended from a back side thereof toward the inside of said accommodation chamber and defining with said cover plate a predetermined contained angle.

7. The toilet chemical dispenser as claimed in claim 6, wherein said flow-guide plate has a length shorter than said cover plate.

8. The toilet chemical dispenser as claimed in claim 1, wherein said mounting device comprises a mounting member having opposing first end and second end and an extension member having opposing third end and fourth end, said third end of said extension member being coupled to said second end of said mounting member, said fourth end flexible and curled up and extendable for hooking on the top edge of the bowl of a toilet.

9. The toilet chemical dispenser as claimed in claim 8, wherein said mounting member comprises a sliding groove and a pawl suspending in said sliding groove; said extension member comprises a series of teeth and is slidably inserted into said sliding groove of said mounting member to let said series of teeth be selectively engaged with said pawl in one of a series of position.

10. The toilet chemical dispenser as claimed in claim 9, wherein said mounting member further comprises a guide groove disposed in said sliding groove; said extension member further comprises a rib extending along one side thereof opposite to said series of teeth and coupled to said guide groove to guide sliding movement of said extension member relative to said mounting member.

11. The toilet chemical dispenser as claimed in claim 8, further comprising a locating plate, said locating plate comprising two locating holes respectively disposed near two distal ends thereof for coupling to the screw bolts on the rear side of the top edge of the bowel of a toilet and a coupling structure located on a middle thereof between said two locating holes, said coupling structure comprising two rails arranged in parallel, two stop flanges respectively extended from a top side of each of said rails along said rails and in direction toward each other and a coupling groove defined by said rails, said stop flanges and said locating plate for receiving said extension member of said mounting device.

12. The toilet chemical dispenser as claimed in claim 11, wherein said locating plate further comprises two hanging slots respectively extended from said locating holes to one side edge of said locating plate.

13. The toilet chemical dispenser as claimed in claim 8, wherein said mounting member is adjustably coupled to said housing, comprising a coupling component located on the first end thereof; said housing comprises a coupling groove adapted for receiving said coupling component.

14. The toilet chemical dispenser as claimed in claim 13, wherein said coupling component comprises at least one body portion and at least one head protruded from said at least one body portion; said housing further comprises two ribs respectively extending along two opposite sides of said coupling groove and partially projecting into said coupling groove to keep said at least one head of said coupling component in said coupling groove.

15. The toilet chemical dispenser as claimed in claim 1, wherein said chemical box comprises a first compartment accommodating a freshener, and a second compartment accommodating a cleaning agent.

16. The toilet chemical dispenser as claimed in claim 1, further comprising a drip pan having opposing first end and second end, said drip pan being pivotally connected to a bottom side of said housing and biasable relative to said housing between a first position where said first end of said drip pan is kept above the elevation of said second end of said drip pan and a second position where said first end of said drip pan is kept below the elevation of said second end of said drip pan, said drip pan being normally kept in said first position subject to the effect of the center of gravity thereof.

17. The toilet chemical dispenser as claimed in claim 16, wherein said drip pan comprises a retaining wall located on the second end thereof, said retaining wall defining with a bottom wall of said drip pan an accumulation chamber for collecting a fluid.

* * * * *